US007264563B2

(12) United States Patent
Dahm

(10) Patent No.: US 7,264,563 B2
(45) Date of Patent: Sep. 4, 2007

(54) RACQUET FOR HITTING A BALL

(76) Inventor: Karin Dahm, Wellenkamp 25, D-30890, Barsinghausen (DE)

( * ) Notice: Subject to any disclaimer, the term of this patent is extended or adjusted under 35 U.S.C. 154(b) by 0 days.

(21) Appl. No.: 11/493,034

(22) Filed: Jul. 26, 2006

(65) Prior Publication Data

US 2007/0087870 A1 Apr. 19, 2007

Related U.S. Application Data

(63) Continuation of application No. PCT/DE2005/000114, filed on Jan. 25, 2005.

(30) Foreign Application Priority Data

Jan. 29, 2004 (DE) ..... 10 2004 004 723

(51) Int. Cl.
*A63B 49/08* (2006.01)

(52) U.S. Cl. ..... 473/549

(58) Field of Classification Search ..... 473/549, 473/551, 527, 524, 568, 560, 298, 300; D21/729
See application file for complete search history.

(56) References Cited

U.S. PATENT DOCUMENTS

| | | | | |
|---|---|---|---|---|
| 3,663,019 | A | 5/1972 | Palotsee | |
| 4,038,719 | A * | 8/1977 | Bennett | 16/430 |
| 4,147,348 | A * | 4/1979 | Lee | 473/526 |
| 4,659,080 | A * | 4/1987 | Stoller | 473/526 |
| 4,759,546 | A | 7/1988 | Steele, Jr. et al. | |
| 5,125,130 | A * | 6/1992 | Stanish | 16/430 |
| 5,482,072 | A | 1/1996 | Cimino et al. | |
| 5,746,661 | A | 5/1998 | Murphy et al. | |
| 6,004,234 | A * | 12/1999 | Majchrowicz | 473/560 |
| 6,364,792 | B1 * | 4/2002 | Evanochko | 473/560 |
| 2003/0181254 | A1 | 9/2003 | Zichmanis | |

FOREIGN PATENT DOCUMENTS

| | | |
|---|---|---|
| BE | 1 005 097 A5 | 4/1993 |
| CH | 685 149 A5 | 4/1995 |
| DE | 296 14 807 U1 | 11/1996 |

OTHER PUBLICATIONS

International Search Report dated Jun. 9, 2005 in PCT application No. PCT/DE2005/000114, filed Jan. 25, 2005 (3 pages).
PCT International Preliminary Report on Patentability in PCT application No. PCT/DE2005/000114, filed Jan. 25, 2005 (6 pages).

* cited by examiner

*Primary Examiner*—Raleigh W. Chiu
(74) *Attorney, Agent, or Firm*—Shlesinger, Arkwright & Garvey LLP

(57) ABSTRACT

Racquet for playing a ball, in particular a ball that is to be hit and/or guided. The racquet includes a shaft. One end of the shaft extends into a handle, while a hitting area is provided at the other end thereof. The handle extends so as to deviate from the axis of the shaft on the plane of the hitting area.

12 Claims, 3 Drawing Sheets

RACQUET FOR HITTING A BALL

CROSS-REFERENCE TO RELATED APPLICATIONS

This application is a continuation of application no. PCT/DE2005/000114, filed Jan. 25, 2005, which claims the priority of German application no. 10 2004 004 723.5, filed Jan. 29, 2004, and each of which is incorporated herein by reference.

FIELD OF THE INVENTION

A multitude of clubs are known in the art from the area of sports and leisure. This includes a first group of clubs with sticks, arranged as a continuation of the longitudinal axis, that have relatively large hitting areas (e.g. rackets for tennis, squash and badminton as well as ping-pong paddles). These clubs are used for hitting the ball in mid-air. There is another group of clubs having a relatively small hitting area that is arranged at an angle relative to the stick (e.g. clubs for ice hockey, hockey, street hockey and golf). These clubs are used to hit and/or guide the ball on the ground, generally holding the club in both hands. Included in this last named group is, for example, the ice hockey stick known from CH-PS 685 149 that provides for the handle at the end of the club to be arranged at an angle in the plane of the hitting area. The angled arrangement is intended to counteract the torsional forces of the lever applying minimal muscle strength and to allow for an improved anatomical wrist position of the upper hitting hand.

For sports disciplines in which the ball must be hit by one hand on the ground—for example, hammerball, B-ball or conaball—the known clubs are not optimal because, in terms of their handling, these clubs are not contoured.

BACKGROUND OF THE INVENTION

The invention is based on a club of the type described above for playing a ball, in particular a ball that must be hit and/or guided by one hand on the ground, comprising a stick the one end of which transitions into the handle and the other end of which has a hitting area arranged thereon, and in the plane of the hitting area the handle extends in such a way that it deviates from the axis of the stick.

OBJECTS AND SUMMARY OF THE INVENTION

The object of the present invention consists in configuring such a club in such a way that its handling helps protect the joints of back, shoulder, arm and wrist. The object is achieved according to the invention by providing that the handle is arched in the plane of the hitting area from the axis of the stick upward and to the front and then again inward and to the back.

The invention achieves that, during the hitting action, the hand does not hold the club in a position that is angled away from the arm; but instead arm and lower arm point approximately in the same direction as the axis of the club. The result is a protective reduction of the strain on wrist, arm and shoulder. Moreover, the accuracy and the effect of the hit are improved.

The angle at which the upward arch of the handle starts is preferably approximately 40 degrees relative to the axis of the stick in order to achieve the protective reduction of strain.

The arch is suitably configured in such a way that the end of the handle is once again aligned with the axis of the stick. But it is even more beneficial if, instead, the handle also comprises a second arch that is arranged as perpendicular relative to the hitting area so that the arch from the axis of the stick extends in the forehand hitting direction.

With this configuration both arches together form a part of a helix, whereby the hand is placed completely relaxed around the handle in an anatomically adjusted position.

If the end of the handle is advantageously configured as enlarged, it is possible to avoid any slipping of the hand along the handle, and any hollow space that may exist under the palm of the hand opposite to the thumb is filled out for different handles.

The handle is suitably provided with adhering devices such as nubs, grooves etc. in order to enhance the grip of the hitting hand, in particular if that hand is sweating.

The hitting area can be configured in many ways. Advantageous embodied examples of hitting area and stick are captioned in sub-claims 19 [sic] to 13.

Subsequently, the invention will be illustrated in more detail using the embodiments demonstrated in the drawings. Shown are in the drawings:

DETAILED DESCRIPTION OF THE INVENTION

Figure 3B:
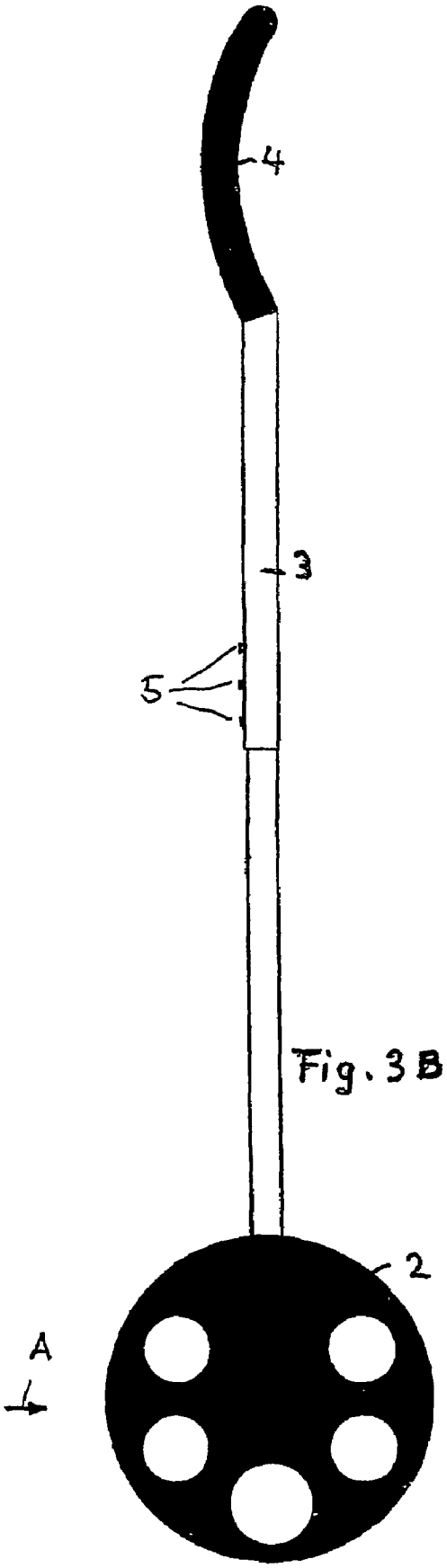
FIGS. 3A and 3B depictions in accordance with FIGS. 1A and 1B but with hitting areas that are attached centrally on the stick.
Figure 3A:
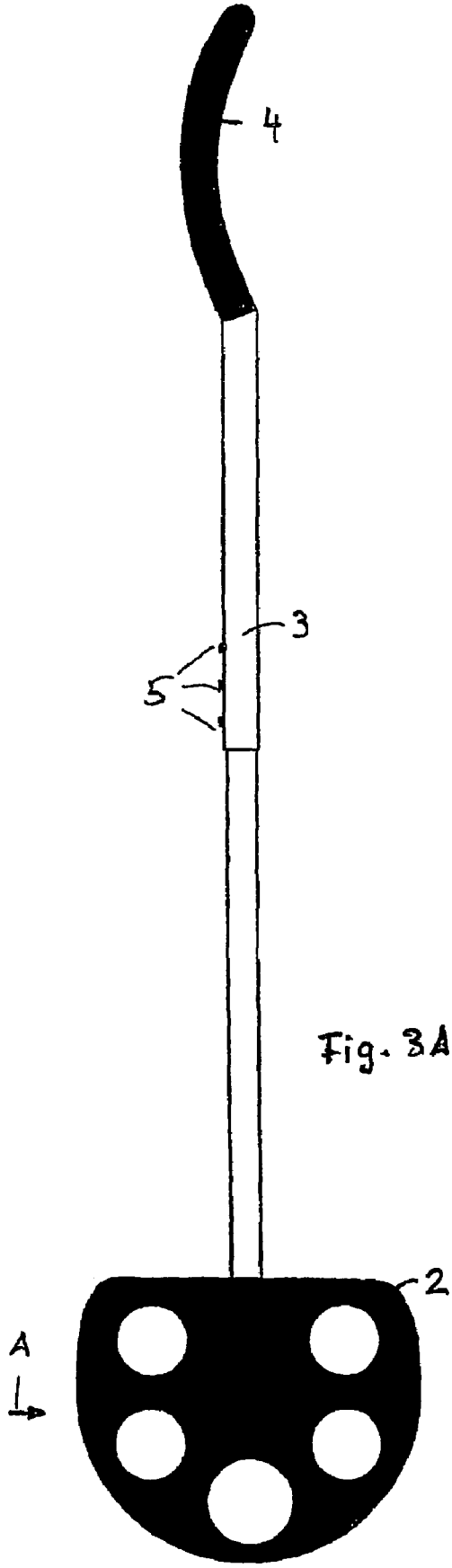

The drawing depicts a club 1 configured according to the invention comprising a hitting area 2, a stick 3 and a handle 4. In both embodied examples shown in FIG. 1A and FIG. 1B hitting area 2 is attached laterally at the end of stick 3; and in the embodied examples shown in FIG. 3A and FIG. 3B hitting area 2 is attached centrally at the end of stick 3. Hitting area 2 consists of a plastic disk of different configurations that is equipped with holes. This is only one possible embodied example of hitting area 2. Hitting area 2 can also be configured as a grate or consist of a frame that has strings tightened across it—comparable to a tennis racket. Club 1 according to the invention is intended, in particular, for hitting or guiding a ball on the ground by one hand as, for example, in hammerball, B-ball or conaball. Therefore, the lower surface of the hitting area and/or of the frame is suitably configured as reinforced. For the same reason stick 3 is made up of two tubes that can be pushed into each other in the way of a telescope; thus the length of stick 3 is changeable and adjustable to the arm length and height of the player, and whereby the length of stick 3 can be anchored with screws 5 that can be fastened through holes in the outside tube and into threaded bores of the inside tube. Preloaded locking pins are also possible instead of screws 5.

Figure 4:
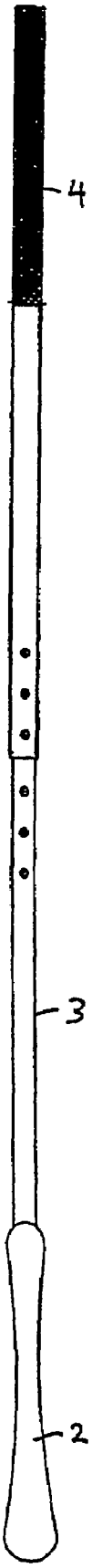
FIG. 4 a view of a club in accordance with FIG. 1 and FIG. 3 in the direction of arrow A (first embodied example)

The special aspect of club 1 according to the invention is its handle 4 that is not just simply angled—as this is the case with the ice hockey stick according to CH-PS 695 149—but that is, in a first embodied example of the invention (FIGS. 1, 3 and 4), arched upward and to the front from axis 6 of stick 3 in the plane of hitting area 2 and then once again arched inward and to the back. As mentioned at the beginning, the result is that the hand does not hold club 1 at an angle when performing a hit, but instead arm and lower arm form approximately a straight line with axis 6 of club 1. This configuration achieves a protective reduction of the strain on wrist, arm and shoulder of the user while the hit is performed. Moreover, the accuracy and effect of the hit are improved.

Figure 2:
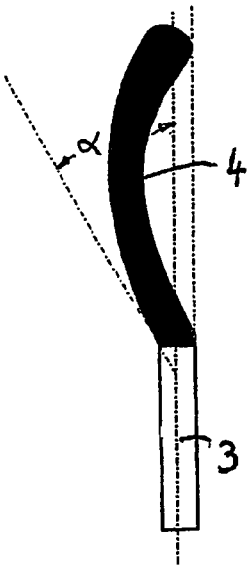
FIG. 2 an embodied example of a handle of the club according to the invention.
Figure 1B:
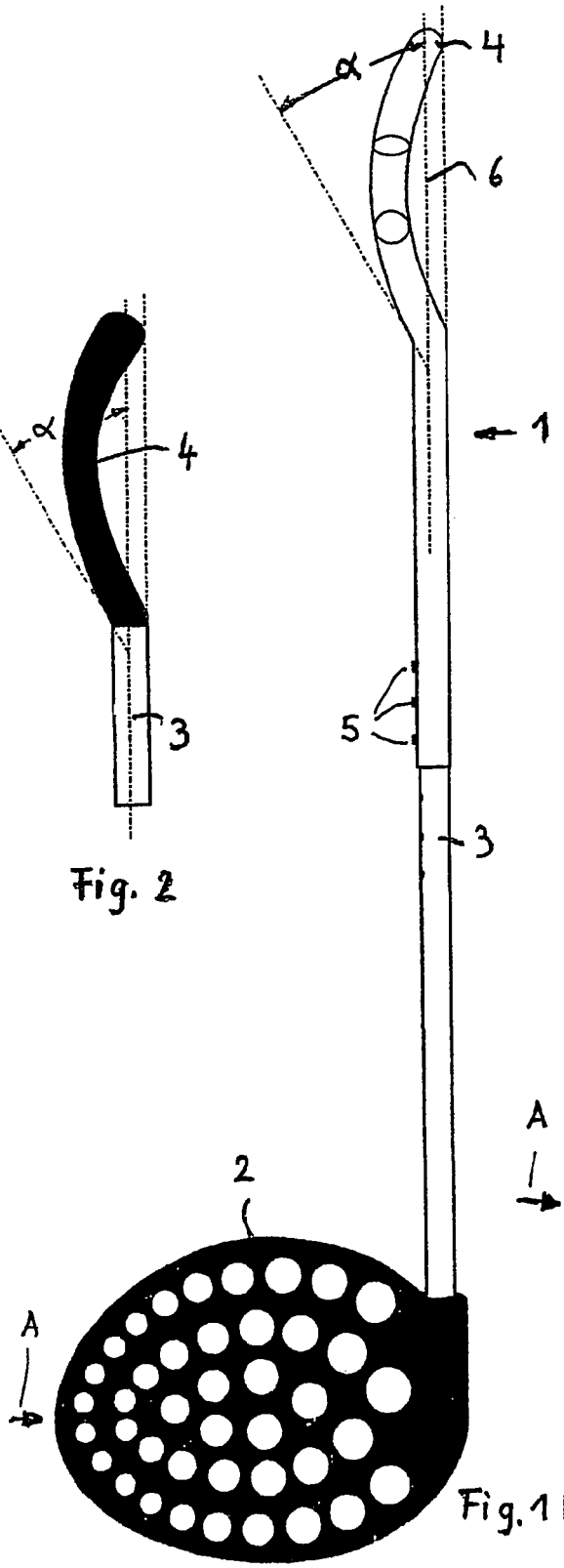
FIGS. 1A and 1B a club in accordance with a first and a second embodied example and with different hitting areas that are attached laterally on the stick.
Figure 1A:
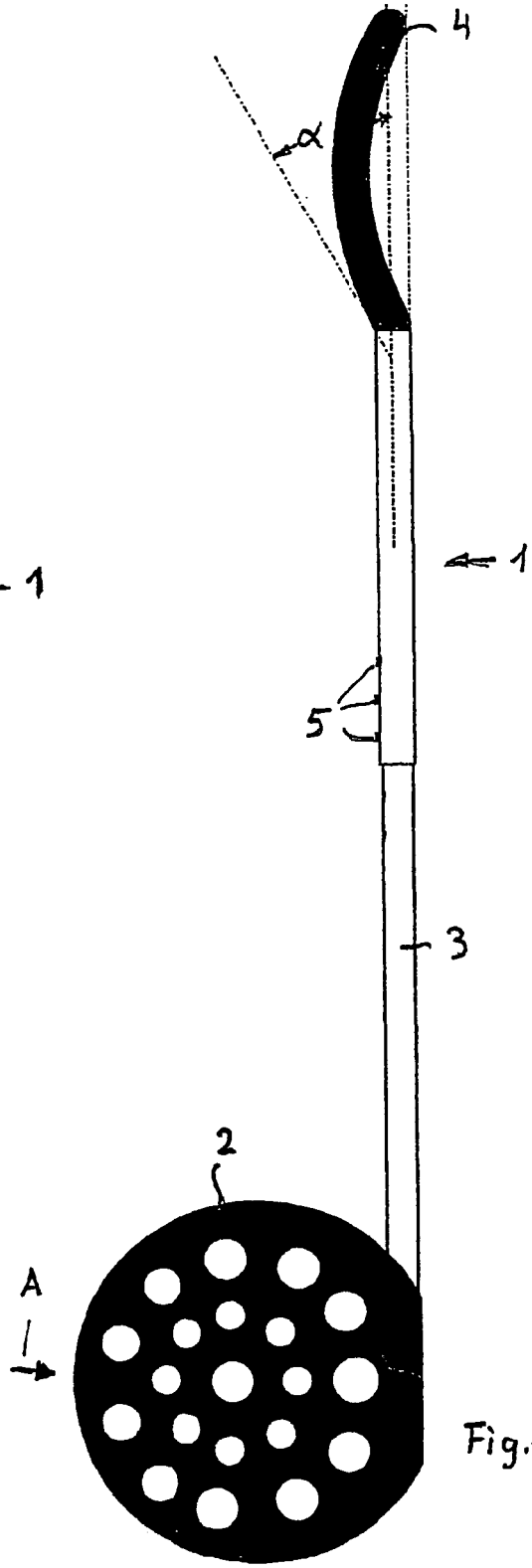

Angle $\alpha$, the angle at which the upward arch of handle 4 starts, is approximately 40 degrees relative to axis 6. In FIG. 1A and FIG. 1B the arch is configured in such a way that the end of handle 4 is once again arranged on axis 6 of stick 3. As demonstrated in FIG. 2, it is advantageous to configure the end of handle 4 as enlarged in order to avoid slipping of the hand along handle 4 and to fill out any hollow space that may exist under the palm of the hand opposite to the thumb for players with hands of different sizes.

Not shown is how handle 4 is equipped with adhering devices such as elastic nubs, grooves etc. in order to improve the grip, in particular when the hitting hand is sweating.

Figure 5:
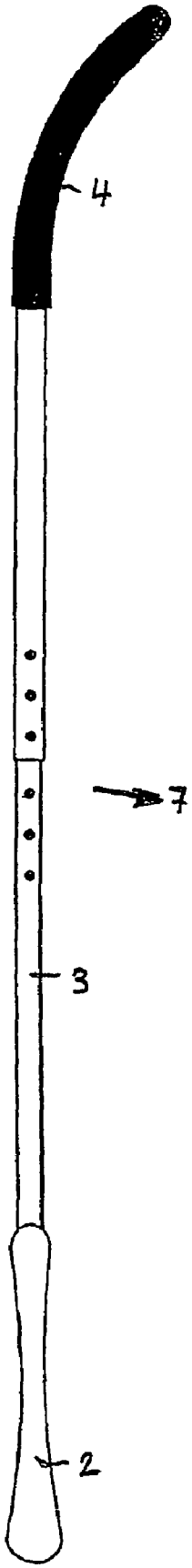
FIG. 5 a view of a club in accordance with FIG. 1 and FIG. 3 in the direction of arrow A corresponding to a second embodied example.

It is especially advantageous if handle 4 comprises, in accordance with another embodied example of the invention, a second arch in addition to the first arch (FIG. 1 and FIG. 3) in accordance with FIG. 5 that is arranged as perpendicular relative to hitting area 2 and that extends from axis 6 of stick 3 in forehand hitting direction 7. In conjunction, the two arches constitute part of a helix. The hand therefore lies completely relaxed and in an anatomically adjusted position around handle 4.

As depicted in FIG. 1B, the cross-section of handle 4 can be configured in different ways. It can either be round as a circle in continuation of stick 3, or it can have an elliptical shape with the main axis of the ellipse being arranged in the plane of hitting area 2.

Handle 4 that is configured according to the invention is particularly suitable for a club that is used for hitting and/or guiding a ball on the ground by one hand. But advantages also result during use of this handle on ice hockey or hockey sticks and tennis rackets.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

What is claimed:

1. Racquet for hitting a ball, the racquet being configured for hitting a ball with one hand, the racquet comprising:

a) a shaft, one end of which shaft transitioning into a handle and including a hitting surface defining a plane disposed at its other end;

b) the handle extending in such a way as to deviate within the plane of the hitting surface from a longitudinal axis of the shaft;

c) the handle being arched within the plane of the hitting surface upward away from and then inwardly back toward the axis of the shaft; and d) the handle extending substantially perpendicularly to the hitting surface, and arched in such a way that its arch extends away from the axis of the shaft in a forehand hitting direction.

2. Racquet as claimed in claim 1, wherein:

a) an angle defining the beginning of the upward arch of the handle is approximately at 40 degrees relative to the axis of the shaft.

3. Racquet as claimed in claim 1, wherein:

a) the arch is configured in such a way that the end of the handle is provided approximately within the axis of the shaft.

4. Racquet as claimed in claim 1, wherein:

a) the end of the handle is enlarged.

5. Racquet as claimed in claim 1, wherein:

a) the handle includes an elliptical cross-section and a main axis of an ellipse of the elliptical cross-section extends in the plane of the hitting direction.

6. Racquet as claimed in claim 1, wherein:

a) the handle includes a grip device, the grip device including one of elastic nubs and grooves.

7. Racquet as claimed in claim 1, wherein:

a) the hitting surface includes a plastic disk including one of a grate and holes.

8. Racquet as claimed in claim 1, wherein:

a) the hitting surface includes strings that are tensioned inside a frame.

9. Racquet as claimed in claim 8, wherein:

a) the hitting surface is enlarged at its end region that is directed away from the racquet.

10. Racquet as claimed in claim 1, wherein:

a) the hitting surface is one of centered and laterally offset at the end of the shaft.

11. Racquet as claimed in claim 1, wherein:

a) the length of the shaft is adjustable.

12. Racquet as claimed in claim 1, wherein:

a) the hitting surface is enlarged at its end region that is directed away from the racquet.

* * * * *